US006112474A

United States Patent [19]

Paine

[11] Patent Number: 6,112,474

[45] Date of Patent: Sep. 5, 2000

[54] RETRACTABLE WEB COLUMN

[76] Inventor: David L. Paine, Rte. 1, Box 192, Ellendale, Minn. 56026

[21] Appl. No.: 09/014,391

[22] Filed: Jan. 27, 1998

[51] Int. Cl.[7] ..... E04H 12/18

[52] U.S. Cl. ..... 52/108; 52/632; 242/390.2; 248/161; 403/364

[58] Field of Search ..... 52/108, 632, 745.17, 52/745.18; 182/41; 242/390.2, 390.3, 917; 248/161; 403/364

[56] References Cited

U.S. PATENT DOCUMENTS

| | | | |
|---|---|---|---|
| 2,130,993 | 9/1938 | Dubilier . | |
| 2,661,082 | 12/1953 | Ziegler . | |
| 2,799,368 | 7/1957 | Alter . | |
| 3,213,573 | 10/1965 | Bohr et al. | 52/108 |
| 3,397,546 | 8/1968 | Eisert . | |
| 3,503,164 | 3/1970 | Berry et al. | 52/108 |
| 3,543,806 | 12/1970 | Rushing et al. | 52/108 X |
| 3,601,940 | 8/1971 | Simon | 52/108 |
| 4,024,595 | 5/1977 | Brown . | |
| 4,089,147 | 5/1978 | Bain . | |
| 4,237,662 | 12/1980 | Kinzler . | |
| 4,386,485 | 6/1983 | Kramer . | |
| 4,651,480 | 3/1987 | Kramer . | |
| 4,920,710 | 5/1990 | Paine . | |

FOREIGN PATENT DOCUMENTS

| | | |
|---|---|---|
| 1361833 | 9/1964 | France . |

OTHER PUBLICATIONS

Articualted Chain Forms triangular lattice Tower, Machine Design Oct. 1, 1959, p. 129.

*Primary Examiner*—Carl D. Friedman
*Assistant Examiner*—Kevin D. Wilkens
*Attorney, Agent, or Firm*—Jacobson & Johnson

[57] ABSTRACT

A retractable column formed from a set of at least three flexible webs with each of the webs having a set of teeth located along opposite edges of the webs, each of the teeth having a first ear obliquely extending from a first side and a second ear obliquely extending from a second side, each of the teeth spaced from an adjacent tooth a base distance substantially equal to a root distance of a tooth on the web so that when a tooth on one of the webs is engaged in a neck to neck relationship with a pair of teeth on one of the other webs the teeth on each of the webs engage each other in an interlocking relationship to hold the webs proximate each other to form a rigid column. By flexing a portion of the teeth that are in engagement with each other one can disengage the interlocked teeth and roll the web onto a take up mechanism and similarly, by flexing a portion of the teeth as the teeth are brought into engagement with one another one can force the teeth into interlocking engagement with each other as the web is unrolled from the take up mechanism.

13 Claims, 6 Drawing Sheets

RETRACTABLE WEB COLUMN

FIELD OF THE INVENTION

This invention relates generally to retractable columns and, more specifically, to a retractable rigid column formed from at least three flexible webs whereby a tooth of one of the webs can be flexed to engage a pair of teeth on an adjacent web to form an interlocked tooth structure or flexed to disengage the teeth to permit storing of the flexible webs in a non-rigid condition.

BACKGROUND OF THE INVENTION

The concept of retractable columns that employ link type structures that can be linked together to form a rigid structure are known in the art. In my prior art U.S. Pat. No. 4,920,710 I disclose a retractable column that can be used to suspend heavy overhead structures such as light banks that are used at concerts with the retractable column formed from a link chain that has C-shaped hooks on opposite edges of the link chain. In contrast, to the multiple links of my prior U.S. and corresponding foreign patents, the present invention utilizes at least three flexible one piece webs that have substantially identical shaped teeth located along the opposite edges of the webs with the spacing between adjacent teeth and the dimension of the teeth sufficient so that the teeth along one edge of one web can be flexed to form interlocking engagement with the teeth along an edge of an adjacent web and thereby hold their webs in restrained engagement with each other to produce a rigid column that requires further flexing of the teeth to unlock the teeth from each other thus ensuring that the column remains in an extended postion.

SUMMARY OF THE INVENTION

Briefly, the invention comprises a retractable column formed from a set of at least three flexible webs with each of the webs having a set of teeth located along opposite edges of the webs with each of the teeth having a crest portion larger than the root portion of the tooth, and each of the teeth spaced from an adjacent tooth at the root line a distance substantially equal to the root of the tooth on an adjacent web so that when the tooth on one of the webs is engaged between a pair of teeth on one of the adjacent webs the teeth on each of the webs engage each other in an interlocking relationship to hold the webs proximate each other in a rigid column. In the interlocked or engaged condition the coaction of the teeth prevent lateral disengagement of the teeth with each other, however; by flexing a portion of the teeth that are in engagement with each other one can disengage the interlocked teeth and roll the web onto a take up mechanism. To form a rigid column one can flex a portion of the teeth to force the teeth into interlocking engagement with each other as the web is unrolled from the take up mechanism.

DESCRIPTION OF THE PRIOR ART

U.S. Pat. No. 4,651,480 discloses an extendible column that utilizes cylindrical members that engage each other in an end to end relationship to provide a rigid structure.

U.S. Pat. No. 2,799,368 discloses an extendible column that uses flexible rolls of steel that uses a set of tongues to engage groves or slots located in an adjacent member.

U.S. Pat. No. 2,130,993 discloses a collapsible rod that uses a set of resilient metal tapes with teeth on the edge of the tape that mesh with teeth on the edge of an adjacent tape.

U.S. Pat. No. 4,386,485 discloses elongated sheets of material with a series of elongated teeth on the edge that adjoin each other in an end to end relationship.

U.S. Pat. No. 4,920,710 discloses a retractable support column that uses link chains to form an extendible column.

U.S. Pat. No. 4,089,147 discloses a module that folds up from an extended postion.

U.S. Pat. No. 3,397,546 discloses a roll out dock.

U.S. Pat. No. 4,024,595 discloses a linkage bridge that can be formed from a plurality of links.

U.S. Pat. No. 4,237,662 discloses a truss made from a flexible sheet material which are formed together by deforming and bending the flexible sheet material to lock the flexible sheet material together.

U.S. Pat. No. 2,661,082 shows a lightweight retractable structure that includes three separate link like sections that are held together by rivet like projections that have a lip that engages a recess in an adjoining link like section. The structure is used to support a lookout platform on top of the structure.

DESCRIPTION OF THE PREFERRED EMBODIMENT

Figure 1:
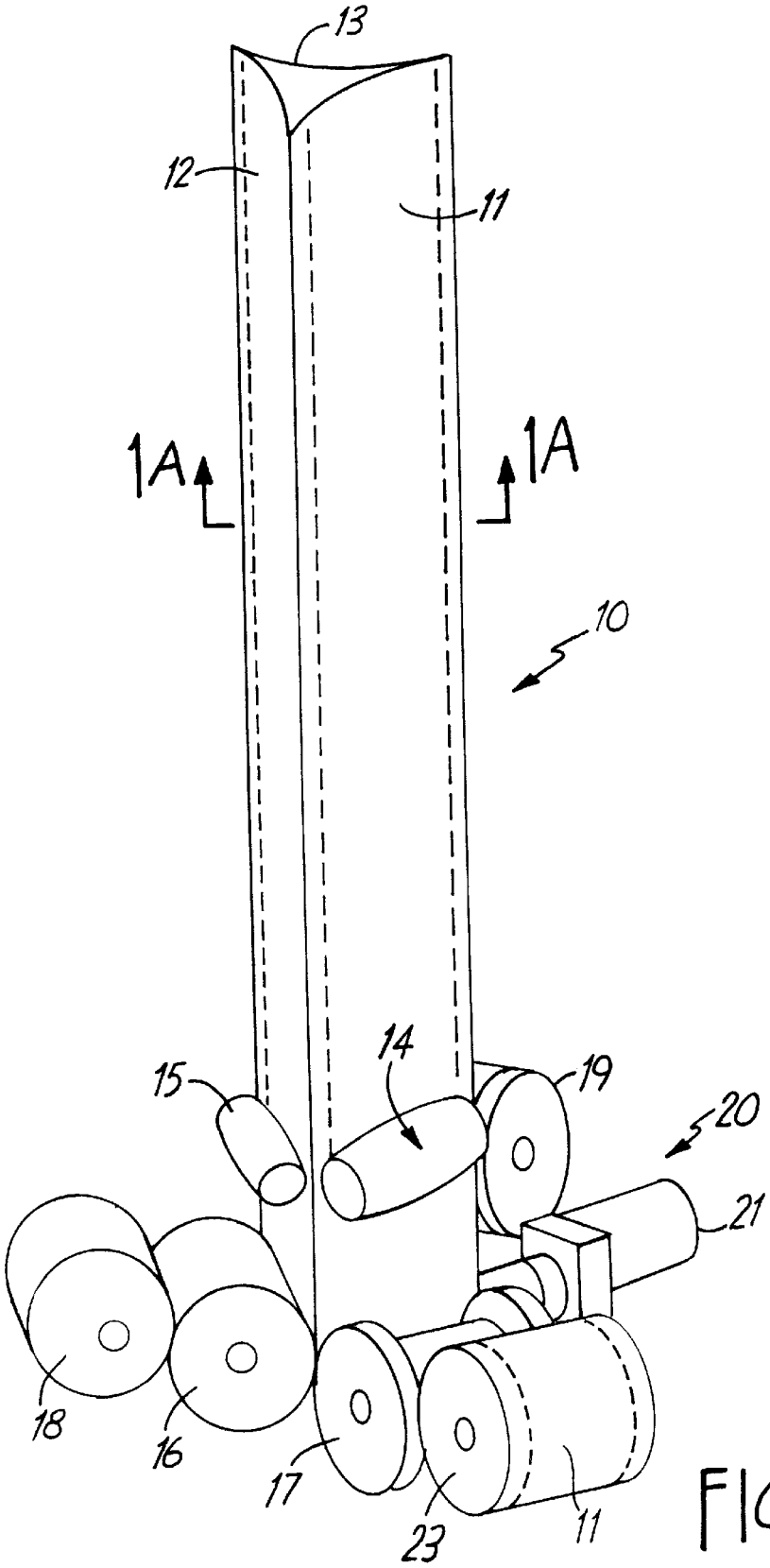
FIG. 1 shows a schematic elevation view of retractable column formed from a set of at least three flexible webs.

FIG. 1 shows a partial schematic of a retractable column 10 formed from a set of at least three flexible webs 11, 12 and 13 with each of the webs having a set of teeth with oppositely angled ears (schematically shown) located along opposite edges of the webs so that the teeth on each of the webs can engage each other in an interlocking relationship to hold the webs in a rigid column.

FIG. 1 also includes a drive system 20 for extending and retracting retractable column 10.

Retractable column 10 is formed from three flexible webs 11, 12 and 13 that have teeth along opposite edges that can be engaged with each other to lock the flexible webs into a rigid triangular column or disengaged with each other to unlock the flexible webs from each other. In the embodiment shown webs 11, 12, and 13 are made from stainless steel ribbon having a thickness of 0.025 inches and have a width of about 7 inches; however, the thickness and size of the webs can be varied depending on the application. The drive system for extending and retracting column 10 includes a set of three web drivers. A first web drive comprised of a drive spool 16, a take up spool 18 and a cambered roller 15 to match and support the design camber of the flexible web 12 as the web is extended upward. A second web drive comprised of a drive spool 17, a take up spool 23 and a cambered roller 14 to match and support the design camber of flexible web 11 as the web is extended upward. A third web drive comprised of a drive spool (not shown), a take up spool 19 and a cambered roller (not shown) to match and support the design camber of flexible web 13 as the web is extended. Each of the drive spools have drive teeth for positively engaging the web to roll or unroll the respective web with the drive spools powered by a motor 21 through a gear mechanism (not shown) that causes all three drive spools to operate in synchronization with each other. That is, all three webs are rolled or unrolled while maintaining the same lateral relationship to each other to permit the teeth on adjoining webs to be engaged or disengaged. Although the system is shown with three drive members a single drive member could be used to drive a single web as the teeth of the driven web can engage the teeth on adjoining webs and simultaneously drive all three webs. Each of the webs is manufactured in the manner of a power spring so that the web when left in a free state will wind on itself to form a tight spiral. In the present embodiment each of the webs wind about the respective take up rolls so that the webs can be controllable unrolled from the wound postion to the extended postion where the teeth on the web engage each other.

Figure 1A:
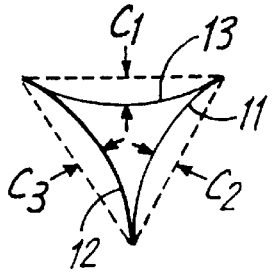
FIG. 1A shows a view taken along lines 1A—1A of FIG. 1.

FIG. 1A shows a sectional view that reveals the inward camber created in the manufacturing process for each of the flexible webs. The camber is indicated as the distances "$C_1$, $C_2$, $C_3$" between a straight line extending from opposite edges of the webs and the actual distance to the middle of the bent web. The use of an inward camber on each of the webs provides additional stiffness to the webs. The camber on each of the webs is supported by camber roller 14, camber roller 15 and a further camber roller (not shown). For example, the camber roller 14 with their larger central diameter then the end diameter coupled with its proximity to web 11 support the camber of web 11 which has flexed inward a distance $C_2$ after the teeth on the webs have engaged each other. The design camber causes each individual web to have added stiffness as a camber member normally has greater resistance to bending than a flat member.

Figure 2:
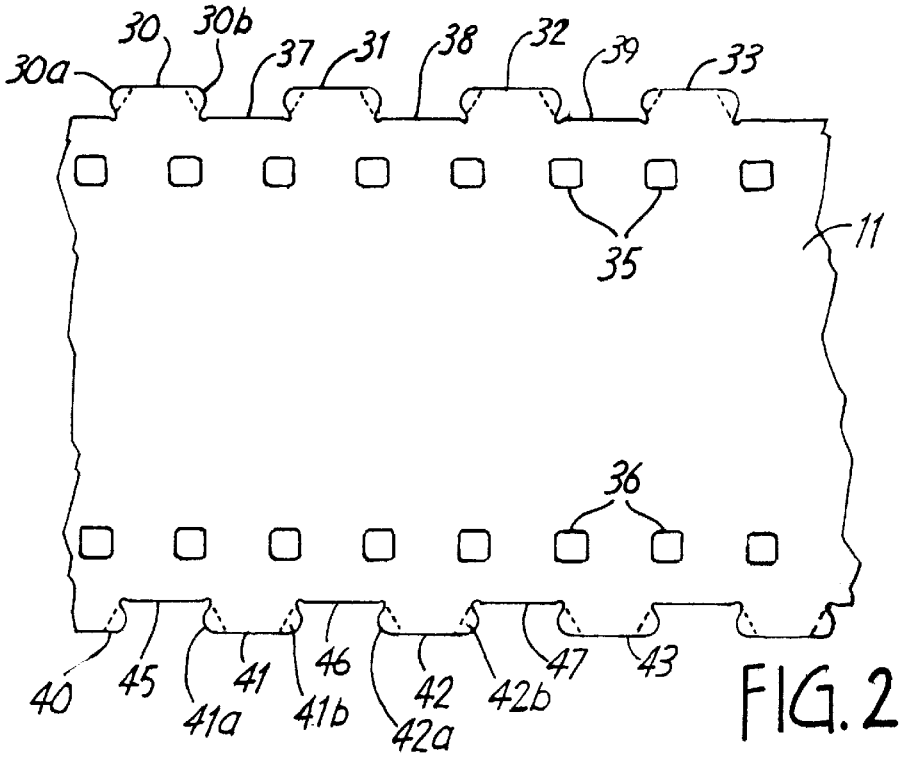
FIG. 2 is a plan view of a flexible web for use in the retractable column of FIG. 1.

To understand the operation of the engagement and disengagement of the webs as well as the retraction and extension of the webs reference should be made to FIG. 2 which shows a plan view of a portion of flexible web 11. Flexible web 11 is shown to have trapezoidal shaped teeth 30, 31, 32 and 33 with oppositely extending ears located along one edge of web 11 and a second set of trapezoidal shaped teeth 40, 41, 42 and 43 with oppositely extending ears 41*a*, 41*b*, 42*a*, and 42*b* located along the opposite edge of web 11. Located between the teeth on the opposite edge of the webs are inverted trapezoidal shaped recess formed by web body 11 and the sides of adjacent teeth 30 and 31. That is, located between teeth 30 and 31 is a web body edge 37, located between adjacent teeth 31 and 32 is a web body edge 38 and located between adjacent teeth 32 and 33 is a web body edge 39.

Located toward the edge of web 11 are two rows of parallel spaced openings 35 and 36 which are engageable by teeth on drive spool 17 to enable the drive spool 17 to either unwind web 11 from take up roller 23 or wind web 11 onto take up roller 23.

Figure 3:
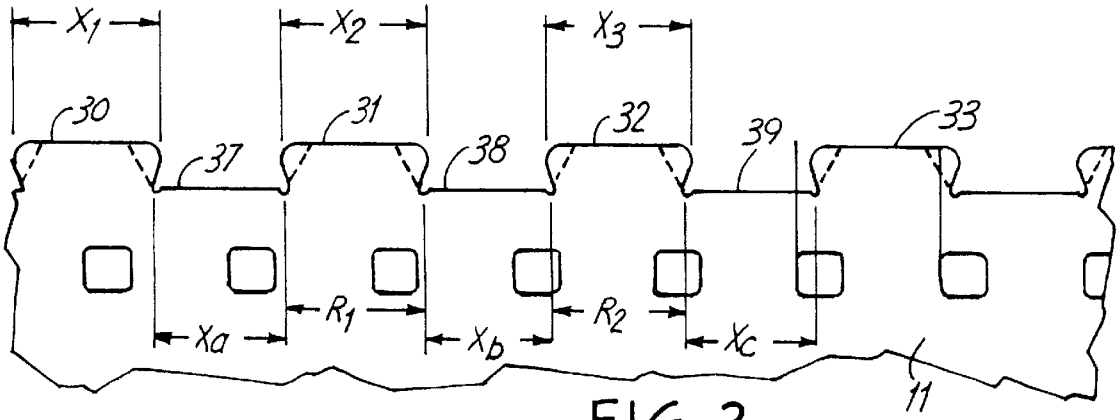
FIG. 3 is an enlarged view of a portion of the flexible web of FIG. 2.

Referring to FIG. 3, each of the teeth and the distance between each of the teeth on web 11 as well as on webs 12 and 13 are progressively spaced so that each of the oppositely angled ears on the teeth can be overlaid on other oppositely angled ears as the web is wound on to their respective rollers. That is, the more web that is rolled onto a take up roller the larger the diameter of the roll, consequently, for the teeth and the oppositely protruding ears of the teeth to overlay one another in a roll without engagement with each other it is necessary to compensate for the increased diameter on the roll by making the teeth and the distance between each of the teeth progressively larger as the diameter of the roll increases.

To illustrate the progressive teeth sizing reference should be made to FIG. 3 which shows a portion of web 11. FIG. 3 shows web 11 with tooth 30 having a crown maximum dimension $x_1$, tooth 31 having a crown maximum dimension $x_2$ and tooth 32 having a crown maximum dimension $x_3$. The base dimensions between tooth 30 and 31 is indicated as $x_a$, the base distance between tooth 31 and tooth 32 is indicated by $x_b$ and the base distance between tooth 32 and tooth 33 is indicated by $x_c$. In order to compensate for the increased diameter of the take up roll the dimensions $x_1$, $x_2$, and $x_3$, are progressively smaller. That is $x_1$ is greater than $x_2$ and $x_2$ is greater than $x_3$. Similarly, the base dimensions are similar progressively sized so that is $x_a$ is greater than $x_b$ and $x_b$ is greater than $x_c$. By coordinating the diameter of the take up roll with the spacing of the teeth and the size of the teeth web one can roll up web 11 so that the protruding ears of the teeth on opposite sides of the web overlay one another in a mating relationship to allow compact storage of the web on the take up spool without having the teeth on the roll engage each other. In order to provide mating engagement between teeth on adjacent webs the teeth on each of the webs would be progressively sized in an identical manner so that the teeth on adjacent webs can properly interlocked with each other.

Figure 7:
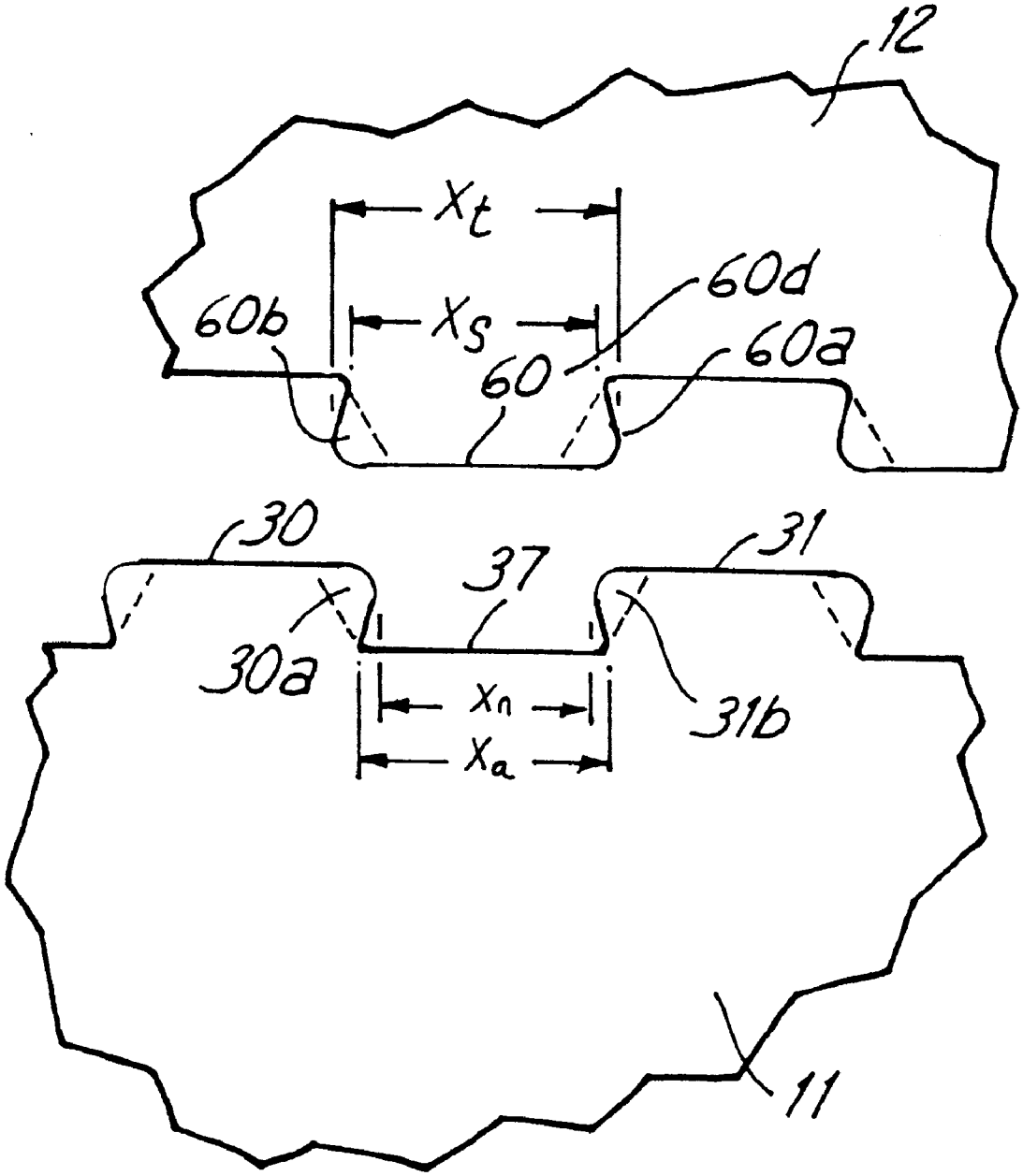
FIG. 7 is a front view of teeth on webs that are to be interlocked with each other.

To understand the interlocking arrangement of teeth on adjacent webs one should refer to FIG. 7 which shows the dimensional interrelationship of a tooth 60 on web 12 related to a pair of teeth 30 and 31 on the opposite web 11. That is, tooth 60 of web 12 can be engaged with a pair of teeth 30 and 31 on an adjacent web 11 to form an interlocked structure. When web 12 is joined to web 11 tooth base or root 60*d* is in engagement with web edge 37 with the obliquely and oppositely extending ears engaging teeth 30 and 31 to prevent the tooth 60 from becoming disengaged when the flexible webs are used as a rigid column. Similarly, located between teeth 40 and 41 is a web body edge 45, located between adjacent teeth 41 and 42 is a web body edge 46 and located between adjacent teeth 42 and 43 is a web body edge 47.

More specifically, FIG. 7 shows web 11 with teeth 30 and 31 having a neck region with base or root spacing therebetween denoted by $X_a$ and a crown spacing therebetween denoted by $X_n$ with the crown spacing less than the base spacing. Web 12 includes a tooth 60 having a neck region with a root dimension $X_s$. and a crown dimension $X_t$ which is greater than the root dimension $X_s$. In the present invention the root dimension $X_s$ of the tooth 60 is slightly smaller than the root distance $X_a$ between adjacent teeth so as to provide a snug but non interference fit when the neck region of tooth 60 is engagement between the neck regions of teeth 30 and 31. However, the tooth 60 crown dimension $X_t$ is larger than either the root distance $X_a$ and the tooth crown spacing $X_n$ between teeth 30 and 31. $R_1$ identifies the root width of tooth 31 and $R_2$ identifies the root width of tooth 32. Consequently, for tooth 60 to engage teeth 30 and 31, tooth 60 must first pass through an interference fit before the teeth 60, 30 and 31 can form interlocking engagement with each other. In the present invention, the oppositely protruding ears 60*a* and 60*b* on tooth 60 and the oppositely protruding ears 30*a* on tooth 30 and 31*b* on tooth 31 provide the necessary flexibility and resiliency to permit the teeth to be engaged and disengaged from each other with the teeth having sufficient stiffness so as to remain in engagement unless the teeth are deliberately flexed to initiate disengagement of the teeth.

Figure 4B:
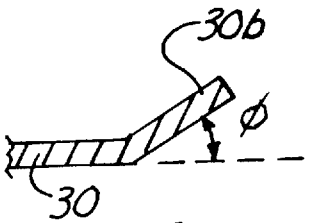
FIG. 4B is a view taken along lines 4B—4B of FIG. 4.
Figure 4:
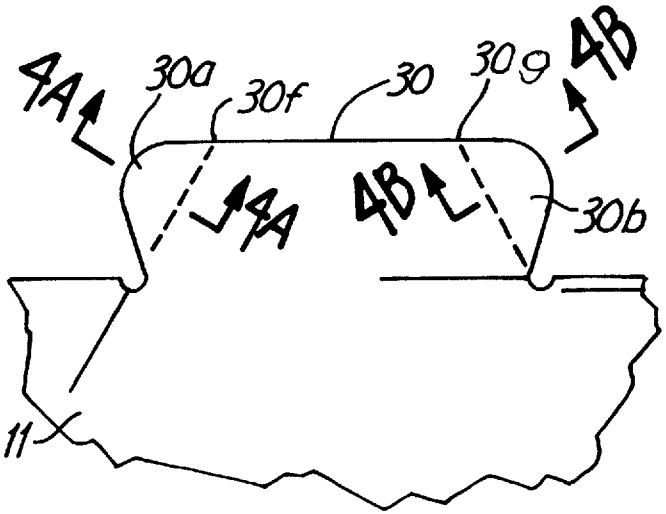
FIG. 4 is a front view of a tooth of the flexible web of FIG. 2.

In order to understand the structure of the oppositely protruding ears on the teeth as well as the three dimensional relationship of the teeth of the present invention reference should be made to FIG. 4 which shows a single tooth 30 having a leading ear 30*a* and a trailing ear 30*b*. As each of the teeth are identical only one of the teeth will be described therein.

Leading ear 30*a* is formed by obliquely bending the corner of tooth 30 along a bend line 30*f* in a first direction and similar trailing ear 30*b* is formed by obliquely bending tooth 30 along bend line 30*g* in a second direction.

Figure 4A:
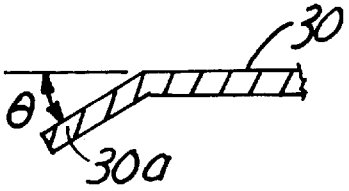
FIG. 4A is a view taken along lines 4A—4A of FIG. 4.

To illustrate the opposite bent ear reference should be made to FIG. 4*a* which shows a view of ear 30*a* taken along lines 4*a*—4*a* to illustrate the bend angle θ which in the embodiment shown is about 30 degrees. Similarly, to illustrate the opposite bend angle θ for the trailing ear reference should be made to FIG. 4*b* which is taken along lines 4*b*—4*b* of FIG. 4 and in the embodiment shown is bent at an angle of about 24 degrees. With the present invention the ears of each tooth project in opposite directions from the web to enable the leading ear 30*a* on tooth 30 to lockingly engage with a trailing ear on a first tooth located on an adjoining web and a trailing ear 30*b* to slidingly and flexingly engage a leading ear on a second tooth until the teeth on each of the adjoining webs are in locked engagement with each other. Although the angle of bend of the ears can be varied the formation of the bend in the ears provides a convenient integral hinge for the ears to flex therealong as the teeth are engaged or disengaged.

Having teeth with ears that are partially bent facilitates interlocking engagement and disengagement of teeth on adjacent webs with each other as the ears tend to flex along the bend line during the engaging or disengaging of adjacent webs. Consequently, the teeth on adjacent webs can be flexed to produce engagement with each other by unrolling the web and flexed to produce disengagement with each other by rolling the web onto a take up spool.

Figure 5A:
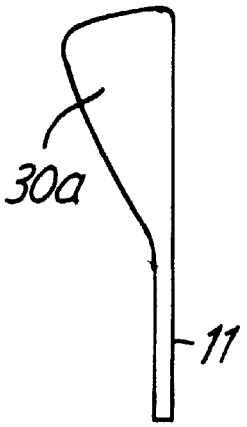
FIG. 5A is a side view of the tooth of FIG. 5.
Figure 5:
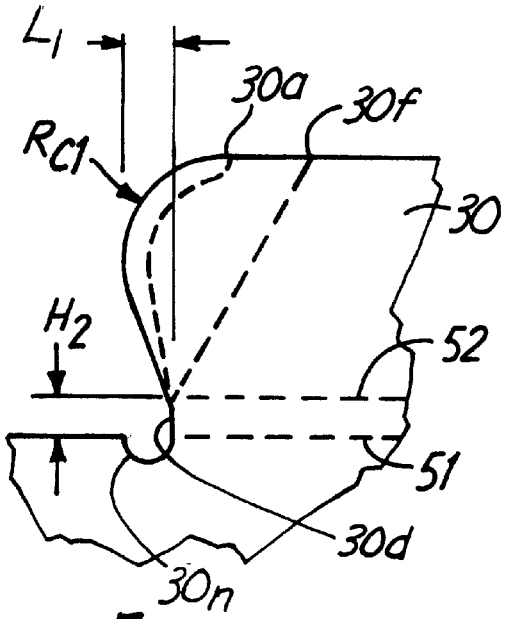
FIG. 5 is a front view of a portion of tooth 30 of FIG. 4.
Figure 6:
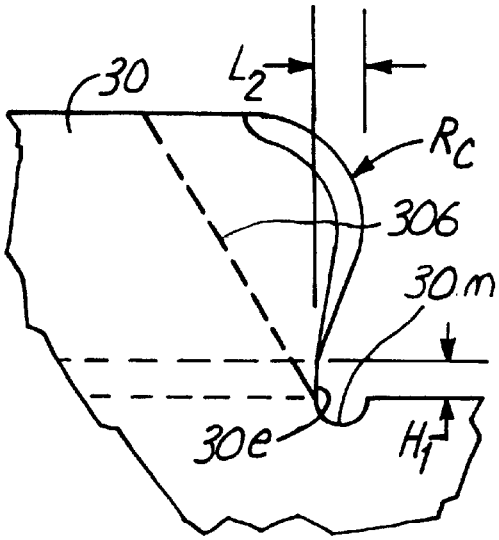
FIG. 6 is a front view of a further portion of the tooth of FIG. 4.

Referring to FIG. 5 a detail of the ear of a tooth is shown with the distance the ear 30*a* projects beyond the base 30*d* of tooth 30 is denoted by $L_1$. Similarly FIG. 6 shows the distance the ear 30*b* projects beyond the base 30*e* of tooth 30 is denoted by $L_2$. Thus the top portion of tooth 30 is larger than the neck or root dimension of adjacent teeth so that when teeth on adjacent webs are in neck to neck engagement the ears of the teeth can interlock with each other to hold the two webs proximate each other.

FIG. 5 shows a stress relief notch 30*n* located at the junction of tooth 30 and adjoining root section and similarly in FIG. 6 a stress relief notch 30*m* is located at the junction of ear 30 with the adjacent root. The purpose of the stress relief notches is provide a wider area so that if the teeth are repeatedly engaged and disengaged the flexing of the ears during of engaging and disengaging to inhibit the stress from concentrating in one area and result in breaking of the tooth during the engagement and disengagement of the teeth with each other.

Figure 6B:
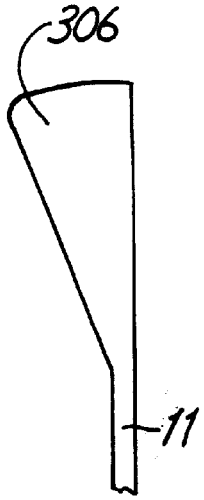
FIG. 6B is a side view of the tooth of FIG. 6.

FIG. 5A is a side view that illustrates how the ear 30*a* is obliquely bent away from web 11 in a first direction and FIG. 6B is a side view that illustrates how ear 30*b* is bent away from web 11 in the opposite direction. A wear area is identified in FIG. 6 and is the region that ear $R_c$ interferingly and flexingly engages with an ear on an opposite web prior to locking into the teeth on an adjacent web. Similarly, the opposite side of ear 30 has a wear area $R_{c1}$. Numeral 30*d* identifies the neck region or side of tooth 30 that projects perpendicularly upward before ear 30*a* begins to extend outward therefrom and numeral 30*e* identifies the neck region or side of tooth 30 that projects perpendicularly upward before ear 30*b* begins to extend outward therefrom. The length $H_1$ of neck regions 30*e* and $H_2$ of 30*e* is sufficient so that it can accommodate the width of a web therein. That is the distance $H_1$ is equal to or slightly greater than the thickness of an adjacent web so that the teeth can fit in the base region. The area defined between dashed lines 51 and 52 is identified herein as the neck region of a tooth. It is the neck regions on each of the teeth on adjacent webs that are in snug but noninterference relationship with each other with the crowns of the teeth on adjacent teeth extending past each other in an interlocking engagement with each other.

Figure 8:
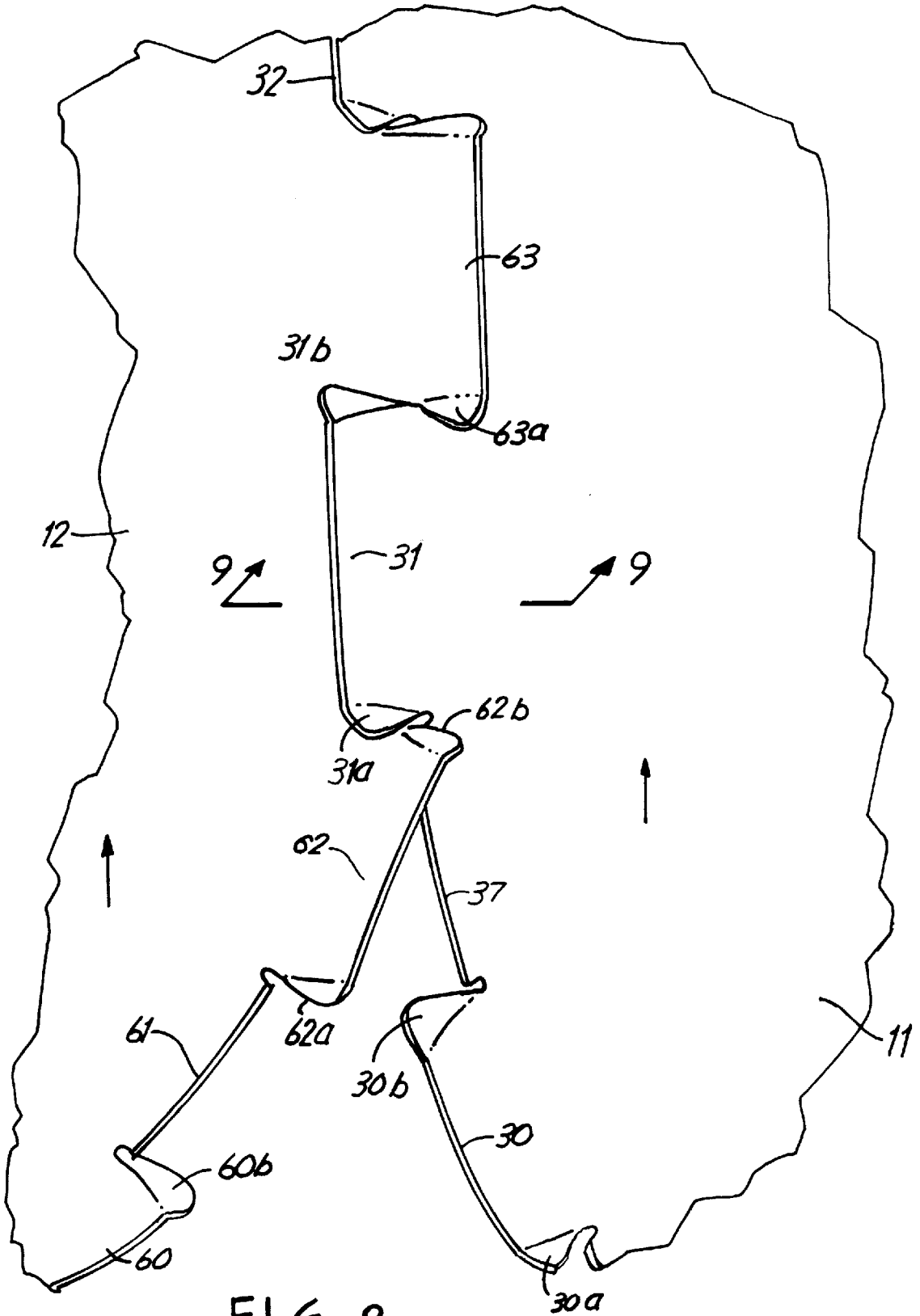
FIG. 8 is a partial side view showing the teeth on adjacent webs interlocking with each other.

In order to illustrate three conditions of the teeth i.e. the locked condition of the teeth, the disengaged position of the teeth, and the forming of locking or unlocking engagement of teeth from adjacent webs with each other reference should be made to FIG. 8. FIG. 8 is a partial side view showing teeth 32 and 31 on web 11 in locked engagement with tooth 63 on web 12 teeth on web 11. Tooth 30 on web 11 and teeth 62 and 60 on web 12 are shown in the disengaged position. Teeth 31 and 30 on web 11 are shown in the condition of forming engagement with tooth 62 on adjacent web 12 if webs 11 and 12 are moving upward as indicated by the arrows. If webs 11 and 12 are moving opposite the arrows FIG. 8 would reflect the disengagement of tooth 62 from teeth 30 and 31.

In the embodiment shown in FIG. 7 each of teeth has a trapezoidal shape and the ears of the teeth project in opposite directions at an angle of at least 20 degrees with respect to a plane thorough the center portion of the tooth.

To illustrate how the teeth go from the disengaged condition to the engaged condition reference should be made to tooth 62 and teeth 31 and 30 of FIG. 8. Tooth 30 is shown having a first angled ear 30*a* and a second angled ear 30*b* and tooth 62 has an angled ear 62*b* and 62*a*. Similarly tooth 31 has an angled ear 31*a*. As webs 11 and 12 are unrolled the teeth on adjacent webs are forced to interact with each other as the webs are brought proximate each other. In the step of forming engagement of teeth on adjacent web note the neck of tooth 62 engages with the neck of tooth 31. In this condition the teeth 31 and 62 are not in interlocking engagement with each other but they are in positive engagement with each other as the ears 31*a* and 62*b* extend past each other. In this condition the top portion of tooth 62 is in positive but not locking engagement with the lower portion of tooth 31. The locking engagement of the teeth on the adjacent webs is formed by extending the ear 62*a* and ear 30*b* past each other until the teeth are in neck to neck engagement to each other as illustrated by the neck to neck relationship between teeth 32, 31 and teeth 63. Once the ears extend past each other as illustrated by teeth 32, 31 and teeth

63 the opposite extending ears thereon will hold the teeth proximate each other in the locked condition. In order for ears to interlock the ears must first flex slightly as the crown spacing between the teeth is such that the ears move past each other before the they can form engagement with each other. For example, ear 62*a* and ear 30*b* which are made from resilient material will bend or flex slightly to allow tooth 62 to become locked between teeth 31 and 30.

The locked condition of adjacent teeth is thus illustrated by tooth 31 which is shown interlocking with tooth 63 and 62 on web 12. That is ear 31*a* and ear 62*b* extend past each other as do ears 31*b* and 63*a* to hold web 11 proximate web 12.

Figure 9:
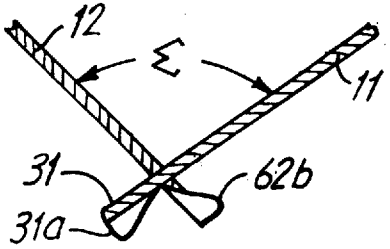
FIG. 9 is a sectional view taken along lines 9—9 of FIG. 8.

FIG. 9 is a cross section view taken along lines 9—9 of FIG. 9 to illustrates how web 11 and web 12 are proximate each other with the teeth in neck to neck relationship and the ears of teeth in overlapping engagement with each other so that the ears prevent withdrawal of the teeth from each other. FIG. 9 is taken along lines 9—9 of FIG. 8 and shows a view looking downward. In this condition ear 31*a* extends past ear 62*b* with the two ears 31*a* and 62*b* projecting laterally and each of the webs at an included angle Σ of 60 degrees.

Thus with the present invention the driving of a single web can cause the teeth of adjacent webs to engage with each other with the neck regions on opposite sides of the webs engaging each other and the trailing ears frictionally engaging each other to cause the ears to flex sufficiently so that the teeth can be brought into neck to neck relationship with the ears of the teeth brought into interlocking engagement with each other to produce a rigid column.

To disengage the webs from each other the direction of the webs is reversed with the webs moving downward opposite the arrows shown in the drawings. In this condition the ears 62*b* and ear 31*a* are pulled away from each other to disengage the teeth. As the ears are made from a resilient material the ears will flex and bend to allow disengagement with each other.

What is claimed is:

1. A retractable column comprising:

a set of at least three flexible webs, each of said webs having a set of teeth located along opposite edges of said webs, each of said teeth having a neck and a crown region with the crown region larger than the neck region, each ot said teeth having a first ear extending in a first direction and a second car extending in a second direction, at least two of said teeth on one of said flexible webs spaced from each other a distance substantially equal to a root distance ot a teeth on another of said flexible webs so the at least two of said teeth on one of said flexible webs can form neck to neck relationship with the teeth on another of said flexible webs with the necks located in snug but non interfering fit while the cars thereon are in overlapping engagement to thereby hold said webs proximate each other to so as to form a rigid column from said three flexible webs with a crown maximum dimension of adjacent teeth being progressively smaller and a base distance between adjacent teeth being progressively smaller.

2. The retractable column of claim 1 wherein the webs are metal.

3. The retractable column of claim 1 wherein each of the teeth have a crest dimension that is greater than a root dimension between teeth on an adjoining web so that each of the teeth that are brought into engagement must first flex in order to bring the teeth into neck to neck engagement with each other.

4. The retractable column of claim 1 wherein each of the webs are stored in a roll.

5. The retractable column of claim 1 wherein each of the webs have an inward camber when the teeth of adjacent webs are in interlocking engagement with each other.

6. The retractable column of claim 1 including a drive spool for unrolling at least one of said webs.

7. The retractable column of claim 1 wherein adjacent teeth on each of said webs define a trapezoidal shape therebetween.

8. The retractable column of claim 1 wherein the webs are made of stainless steel.

9. The retractable column of claim 1 wherein the teeth on adjacent webs form interlocking engagement with each other.

10. The retractable column of claim 1 wherein each of said webs comprise a single piece of flexible material.

11. The retractable column of claim 1 wherein said teeth are resilient to permit flexing during an engaging or disengaging thereof.

12. A retractable column comprising:

a set of at least three flexible webs each of said webs having a set of teeth located along opposite edges of said webs, each of said teeth having a neck and a crown region with the crown region larger than the neck region each of said teeth having a first ear extending in a first direction and a second ear extending in a second direction, at least two of said teeth on one of said flexible webs spaced from each other a distance substantially equal to a root distance of a tooth on another of said flexible webs so the at least two of said teeth on one of said flexible webs can form neck to neck relationship with the tooth on another of said flexible webs with the necks located in snug but non interfering fit while the ears thereon are in overlapping engagement to thereby hold said webs proximate each other to so as to form a rigid column from said three flexible webs with the teeth on each of the webs progressively smaller to enable the webs to be stored on a roll with the ears on the teeth mating with other teeth on the roll.

13. A retractable column having a set of at least three flexible webs, each of said webs having a set of teeth located along opposite edges of said webs, each of said teeth having a neck and a crown region with the crown region larger than the neck region, each of said teeth having a first ear extending in a first direction and a second ear extending in a second direction, at least two of said teeth on one of said flexible webs spaced from each other a distance substantially equal to a root distance of a tooth on another of said flexible webs so the at least two of said teeth on one of said flexible webs can form neck to neck relationship with the tooth on another of said flexible webs with the necks located in snug but non interfering fit while the ears thereon are in overlapping engagement to thereby hold said webs proximate each other to so as to form a rigid column from said three flexible webs and wherein each of said teeth has a trapezoidal shape and the ears of the teeth project in opposite directions at an angle of at least 20 degrees with respect to a plane through a center portion of the tooth.

* * * * *